United States Patent [19]

Loughlin et al.

[11] Patent Number: 4,885,919

[45] Date of Patent: Dec. 12, 1989

[54] SLIDING SHACKLE PADLOCK

[76] Inventors: Robert W. Loughlin, P.O. Box 129, Stanton, N.J. 09885; Thomas G. Loughlin, 201 E. 17th St., Apt. 30F, New York, N.Y. 10003

[21] Appl. No.: 246,861

[22] Filed: Sep. 20, 1988

Related U.S. Application Data

[63] Continuation-in-part of Ser. No. 94,708, Sep. 9, 1987, abandoned, and a continuation-in-part of Ser. No. 205, Jan. 2, 1987, abandoned, and a continuation of Ser. No. 673,181, Oct. 19, 1984, abandoned.

[51] Int. Cl.[4] ..... E05B 67/36

[52] U.S. Cl. ..... 70/34; 70/53

[58] Field of Search ..... 70/23, 32, 33, 34, 38 R, 70/38 A, 38 B, 38 C, 39, 53, 417, 2–13

[56] References Cited

U.S. PATENT DOCUMENTS

| | | | |
|---|---|---|---|
| 2,048 | 11/1842 | Roper et al. . | |
| 1,008,979 | 11/1911 | Mews . | |
| 1,592,696 | 7/1926 | Heyer | 70/34 |
| 1,863,503 | 6/1932 | Schlitz . | |
| 2,079,578 | 5/1937 | Schlesinger . | |
| 2,193,368 | 3/1940 | Harrison | 70/32 |
| 2,407,400 | 9/1946 | Dutton . | |
| 3,392,555 | 7/1968 | Beaver . | |
| 3,590,607 | 7/1971 | Beaver . | |
| 3,652,114 | 3/1972 | Cady . | |
| 3,820,360 | 6/1974 | Best . | |
| 3,828,591 | 8/1974 | Beaver . | |
| 4,033,155 | 7/1977 | De Lucia . | |
| 4,033,156 | 7/1977 | Cottingham . | |
| 4,062,206 | 12/1977 | McWhorter | 70/14 |
| 4,106,315 | 8/1978 | Dohanyos . | |
| 4,157,653 | 6/1979 | Dohanyos . | |
| 4,183,235 | 1/1980 | Coralli | 70/34 |
| 4,229,955 | 10/1980 | Coralli | 70/32 |

*Primary Examiner*—Robert L. Wolfe

*Attorney, Agent, or Firm*—Lerner, David, Littenberg, Krumholz & Mentik

[57] ABSTRACT

A sliding shackle padlock for securing an outwardly opening door or closure provides a tapered shackle for cooperatively engaging the staple of a hasp or another fastening member on the door or closure, which may be removably secured to a door jamb. A protective cover is provided to conceal the locking arrangement between the tapered shackle and the staple or other fastening member. A ratchet arrangement or a spring clip arrangement is utilized to maintain the shackle in the shackled position within the staple or other fastening member.

32 Claims, 9 Drawing Sheets

SLIDING SHACKLE PADLOCK

CROSS REFERENCE TO RELATED APPLICATION

This application is a continuation-in-part application of U.S. application Ser. No. 094,708 filed Sept. 9, 1987, now abandoned which application Ser. No. 094,708 is a continuation-in-part application of U.S. application Ser. No. 000,205 filed on Jan. 2, 1987, now abandoned which application Ser. No. 000,205 is a continuation of U.S. application Ser. No. 673,181 filed on Nov. 19, 1984, now abandoned.

BACKGROUND OF THE INVENTION

The present invention relates generally to padlocks for use in conjunction with a hasp or the like, and more particularly to sliding shackle padlocks for securing outwardly opening doors or other closures.

Conventional padlocks, cooperating with an associated hasp to secure doors, equipment, storage spaces, etc., have proven unsatisfactory in preventing unauthorized access to enclosed areas and in securing equipment. The designs of prior art padlocks lend themselves to being defeated by cutting and prying tools. Even when used in cooperation with conventional shields, shrouds, and/or enclosures, known padlocks have not been able to thwart a determined thief from gaining access to the supposedly secured space. The principal problem is that padlock shackles as shown in FIGS. 1 and 2 generally do not fit snugly within a hasp thereby affording easy insertion of prying or cutting tools to break the lock.

In most prior art shielded padlock arrangements, the massive shape or inherent design limitations of the shield require that it be permanently mounted to the structure to be secured thereby inhibiting both the transferability and use of the shield in other locations.

Those prior art shielded padlock assemblies which are not permanently fixed to a wall or door are generally comprised of a modified piece added to an existing conventional padlock for use with a specifically identifiable hasp, and are generally incapable of cooperating with other hasps of differing sizes and shapes.

Constructing prior art shields out of high strength alloy steels and other special materials in order to impair the effectiveness of conventional cutting and prying tools has considerably increased the cost of prior art shielded padlocks while generally doing little to prevent a forced attack.

It is therefore a principal object of the present invention to provide a sliding shackle padlock which will provide a tight fit between the haps and the sliding shackle in order to prevent the insertion of prying or cutting tools therebetween.

Another object of the present invention is to provide a tight fitting padlock to which a shield may be attached and which may be utilized with a variety of hasp sizes.

It is a further object of the present invention to provide a sliding shackle padlock which is both reliable and inexpensive to manufacture.

It is yet a further object of the present invention to provide a sliding shackle padlock which is particularly adapted to secure outwardly opening doors or other closures and which hides the hasp, or at least the staple of the hasp, on which the sliding shackle padlock is fixed.

It is yet a further object of the present invention to provide a sliding shackle padlock system having a means removably connected to a door jamb and on which a sliding shackle padlock can be secured to prevent the door from being opened.

SUMMARY OF THE INVENTION

The sliding shackle padlock of the present invention includes a frame having a base on which a shackle slides. The slidable shackle includes a main body that extends into a toe portion. The toe portion of the shackle includes tapered side walls that are separated by a distance that gradually decreases toward the distal end of the toe. In an alternate embodiment, the toe portion is tapered in both the lateral and longitudinal directions. The toe also includes a flat base portion with two flat walls extending substantially vertical therefrom. An additional wall extending from the top of each flat wall may be either curved or angles to a flat top surface. The padlock includes means for maintaining the sliding shackle in a locked position and the entire padlock may be housed in a casing to hide at least the staple of the hasp. An alternate embodiment of the present invention provides fastening means which is adapted to be removably connected to a door jamb and to cooperate with a sliding shackle padlock, in place of a hasp device, to secure a door from unauthorized intrusion. Other embodiments include ratchet means to enable the toe portion of the sliding shackle to be inserted an optimum distance into the staple of the hasp or other fastening means thereby providing a more snug arrangement between the shackle and the staple or placing other fastening means in greater tension.

These and other features and objects of the present invention will be more completely described below in the following detailed description which should be read in light of the accompanying drawings in which corresponding reference numerals refer to corresponding parts throughout the several views.

DETAILED DESCRIPTION OF THE PREFERRED EMBODIMENTS

Figure 1:
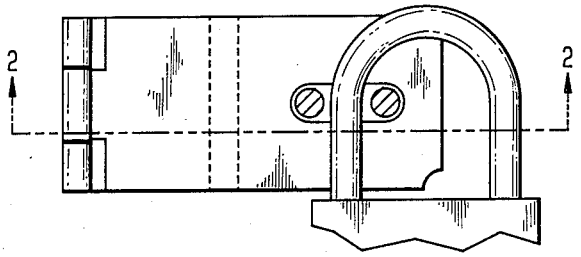
FIG. 1 (PRIOR ART)
FIG. 1 is a plan view, partly in section, of a prior art hasp and padlock device.
Figure 2:
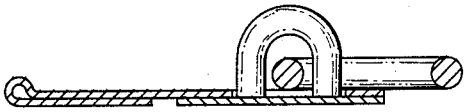
FIG. 2 (PRIOR ART)
FIG. 2 is a sectional view taken along lines 2—2 of FIG. 1.
Figure 4:
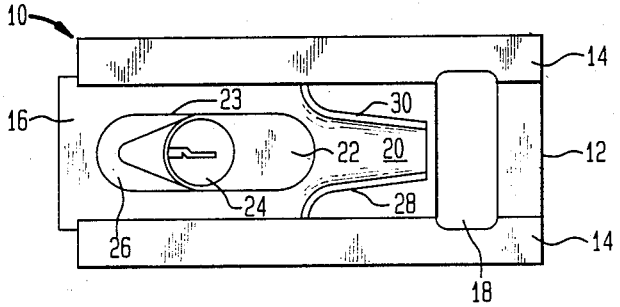
FIG. 4 is a top plan view of the sliding shackle padlock shown in FIGS. 3*a*–3*b;*
Figure 6:
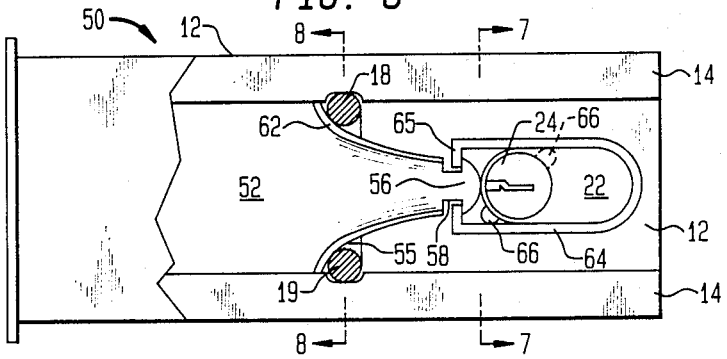
FIG. 6 is a top plan view, partly in section, of the sliding shackle padlock shown in FIGS. 5*a*–5*b;*
Figure 3A:
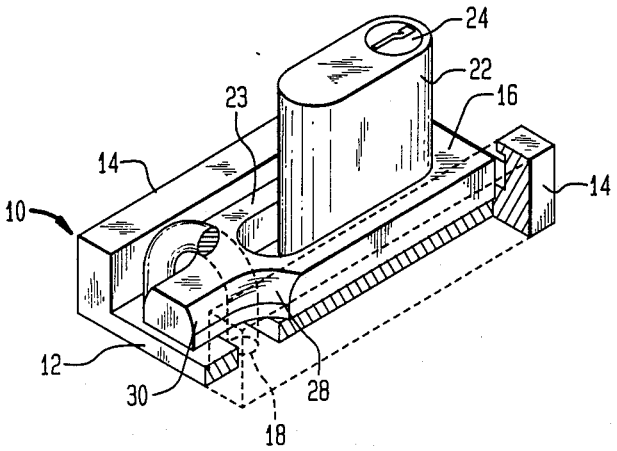
FIG. 3*a* is a perspective view, partly in phantom and partly in section, of a first embodiment of the sliding shackle padlock of the present invention in a locked state.
Figure 5A:
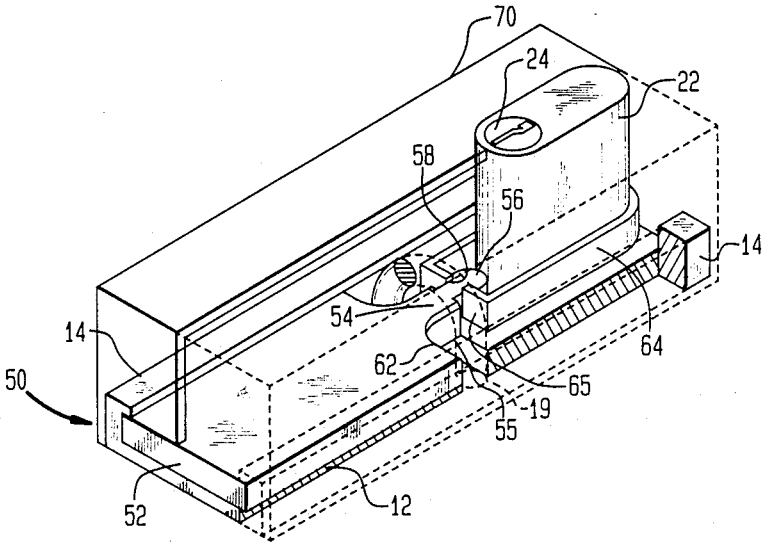
FIG. 5a is a perspective view, partly in phantom and partly in section, of a second embodiment of the sliding shackle padlock of the present invention in a locked state.
Figure 3B:
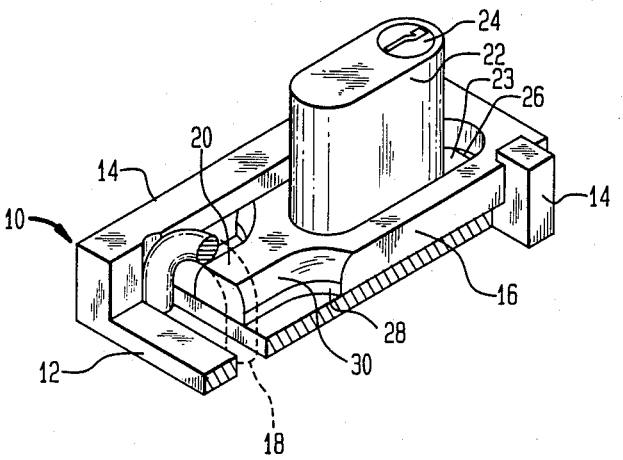
FIG. 3*b* is a perspective view, partly in phantom and partly in section, of the sliding shackle padlock shown in FIG. 3*a*, illustrating the same in an unlocked state.
Figure 5B:
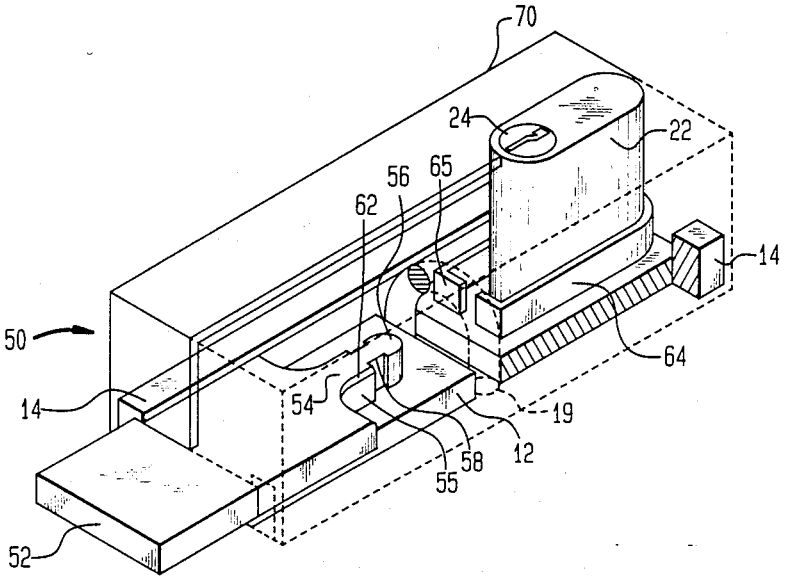
FIG. 5*b* is a perspective view, partly in phantom and partly in section, of the sliding shackle padlock shown in FIG. 5*a*, illustrating the same in an unlocked state.
Figure 8:
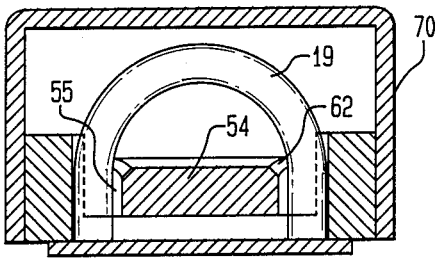
FIG. 8 is a sectional view of the sliding shackle padlock shown in FIGS. 5*a*, 5*b* and 6, as taken along lines 8—8 of FIG. 6.
Figure 7:
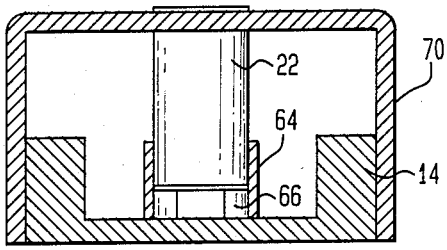
FIG. 7 is a sectional view of the sliding shackle padlock shown in FIGS. 5*a*, 5*b* and 6, as taken along lines 7—7 of FIG. 6.

Referring to FIGS. 3*a*, 3*b* and 4, there is shown a first embodiment of the sliding shackle padlock 10 of the present invention. The padlock 10 includes a base 12 from which side walls 14 extend in the longitudinal direction along both sides of the base 12. In this first embodiment, the side walls 14 extend from the base 12, which is wider than the distance between the side walls 14, and also include longitudinal grooves that receive the sliding shackle 16. The grooves have a height just slightly greater than the height of the shackle in order to allow the shackle 16 to slide freely through the grooves.

A slot 18 extending substantially across the width of the base 12 is provided near one end of the padlock so that a staple 19 of a hasp may pass therethrough. The cylinder 22 extends from the base 12 and passes through a slot 23 in the sliding shackle 16. The sliding shackle 16 is slid so that a thin metal spring plate 26, which is positioned at one end of the base side of the slot 23, is secured under the shackle 16 by a locking mechanism (not shown). The locking mechanism may include a depression extending partially across the width of the base 12 which receives an edge of the spring plate. A cam activated by the turning of a key exerts a pressure on the spring plate 26 thereby uplifting and disengaging it from the base carried depression. Conventional means for locking a shackle in a fixed position may also be utilized.

When in a locked position, the toe portion 20 of the sliding shackle 16 passes over the slot 18 and through the opening of the staple 19. An extra tight and secure fit between the sliding shackle 16 and the staple 19 results from the use of tapered side surfaces 28 which are angled from the widest portion of the sliding shackle 16 to the narrowest portion of the shackle, that is, the distal end of the toe portion 20. This tapering provides for the secure locking of the staple 19 because the sides of the toe portion 20 rest against the inner surfaces of each side of the staple 19 thereby preventing the insertion of prying or cutting tools between the staple 19 and the toe portion 20 of the shackle 16. Further enhancing the secure, tight locking fit are the tapered top corners 30 of the toe portion 20. It will be appreciated that the tapered top corners 30 are provided so that the toe portion 20 more closely approximates, in cross-section, the shape of the staple 19. Thus, tapered corners 30 enable the toe portion 20 to abut a greater surface area of the inner surface of the staple 19 through which the toe portion 20 passes.

Referring now to FIGS. 5–8, a second embodiment of the present invention is shown. The padlock 50 of FIGS. 5–8 includes a base 12 having side walls 14 extending in the longitudinal direction along each side of the base 12. A sliding shackle 52 slides between the side walls 14 and includes a toe portion 54 extending from one end thereof. The toe portion 54 includes a rounded head 56 with a notches 58 located between the rounded head 56 and the remainder of the toe portion 54. The sides 55 of the toe portion 54 from the end of the main shackle body 52 to the notches 58 taper from a width which is greatest adjacent the shackle body to its narrowest portion adjacent the notches 58. The top corners 62 of each side 55 of the toe portion 54 are preferably tapered in some fashion so that the top corner is not a sharp 90° angle, as in the first embodiment.

The preferred arrangement for locking the sliding shackle 52 is a locking spring mechanism which includes a spring 64 that surrounds a cylinder 22. At each end of the spring 64 an inwardly extending projection 65 is attached so that the two inwardly extending elements face each other. As the rounded head 56 strikes the projections 65, the projections 65 are forced away from each other until they are separated by a distance equal to the width of the rounded head 56. At that point, the rounded head 56 passes between the projections 65 until the projections 65 fall into the notches 58 thereby securing the shackle 52 in a locked position.

In order to unlock the sliding shackle 52, a cam arrangement which is activated by the turning of a key inserted into keyway 24 is utilized. The cam arrangement includes a cam section 66, shown in FIGS. 6 and 7, which upon the turning of the key rotates thereby separating the projections 65 of the spring 64 to a point where the rounded head 56 of the toe portion 54 may pass between. In order to facilitate the unlocking of the lock, a spring (not shown) may be associated with the sliding shackle 52 to assist in urging the rounded head in a direction away from the cylinder 22.

A slot 18 extends through the base of the padlock 50 through which can project the staple 19 of a hasp. The padlock is placed over the staple 19, so that the staple 19 passes through the slot 18 and the shackle 52 is slid towards the staple 19 so that the toe portion 54 passes through the opening of the staple 19 until the projections 65 of the spring 64 capture the rounded head 56, as described above. To release the spring, the key is inserted in the keyway 24 and turned thereby turning the cam device 66 which separates the projections 65 of the spring 64.

A sliding shackle padlock of the present invention may also be surrounded by a shroud 70 which is placed over the locking mechanism and completely surrounds the locking mechanism thereby preventing access to the components of the padlock.

Figure 9:
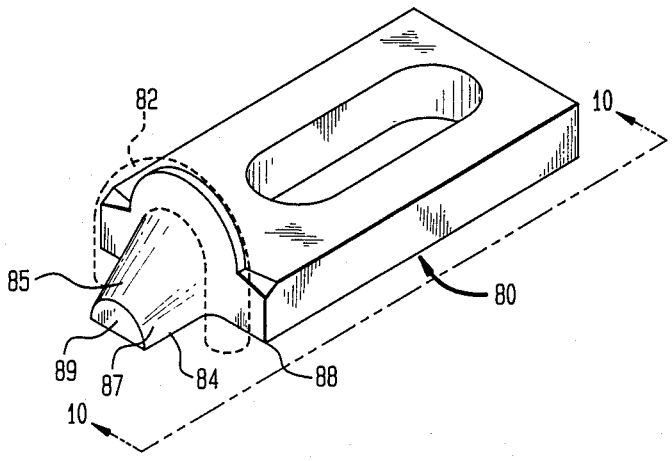
FIG. 9 is a perspective view, partly in phantom, of a third embodiment of the sliding shackle padlock of the present invention in a locked state.
Figure 10:
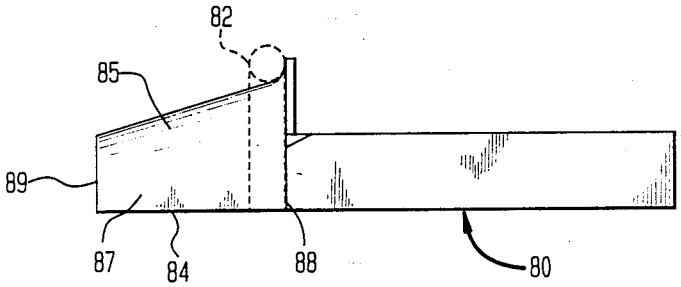
FIG. 10 is a sectional view of the shackle in a locked state, as taken along lines 10—10 of FIG. 9.
Figure 13:
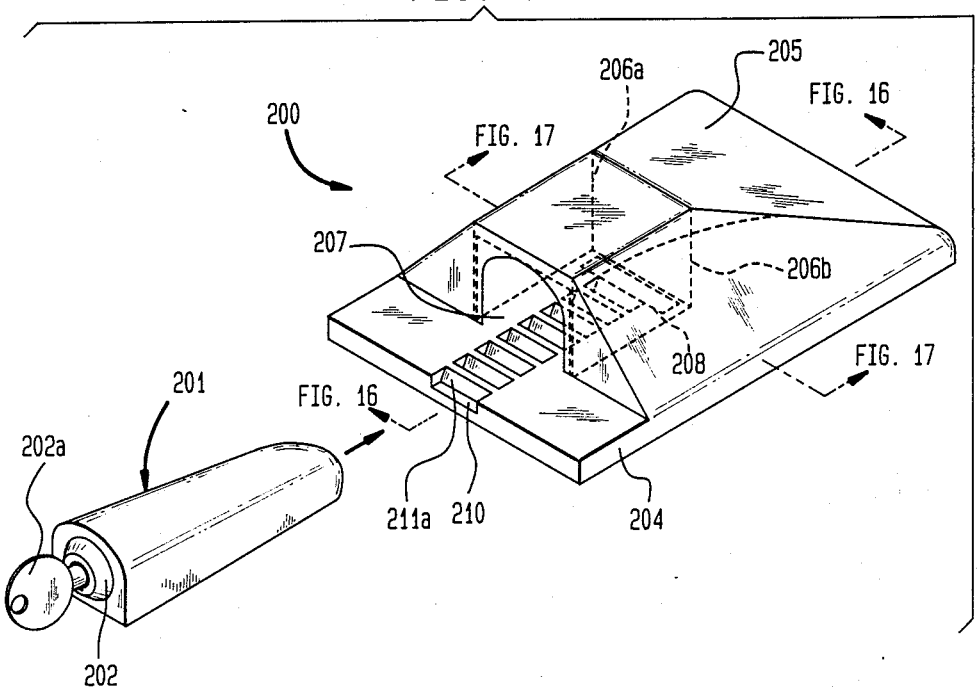
FIG. 13 is an exploded perspective view of a sliding shackle padlock in accordance with a fifth embodiment of the present invention showing a sliding shackle component and a base component.

Referring to FIGS. 9 and 10 there is shown a third embodiment of the present invention. Shackle 80, similar to the sliding shackle of FIGS. 3*a*, 3*b* and 4, is shown in the locked position with staple 82 of a hasp (not shown). As the staple 82 does not completely project through the slot in the hasp swingplate, the opening is in the form of a truncated ellipse. Shackle 80 includes a toe portion 84 having a cross-sectional shape matching the shape of the staple opening. The toe portion 84 is tapered along the top 85 and side walls 87 thereof from the widest portion 88 of the shackle 80 to the distal end 89. The taper thereby provided is in the horizontal and vertical planes and runs along the entire periphery of the toe portion 84, excluding the bottom, resulting in a shape similar to a longitudinally truncated cone. The peripheral taper of the toe portion 84 provides an extra snug fit between the shackle 80 and the staple as the surface of the tapered toe portion 84 abuts the projected staple all along the inner perimeter thereof.

Figure 11:
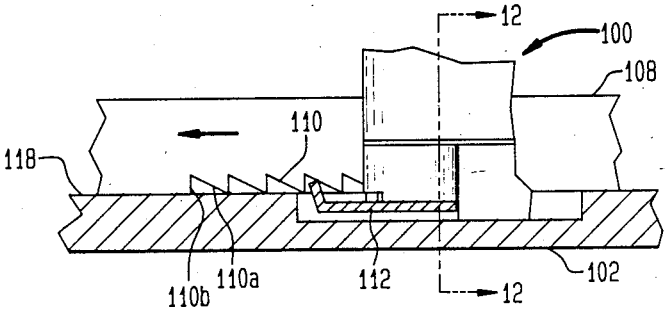
FIG. 11 is a partial sectional view of a fourth embodiment of the sliding shackle padlock of the present invention that includes a ratchet and pawl arrangement.
Figure 12A:
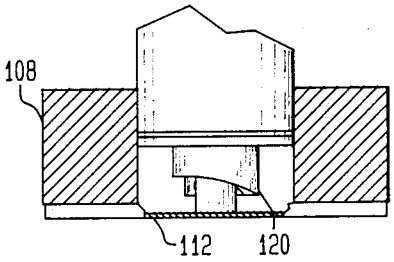
FIGS. 12*a* and 12*b* are partial sectional views of the sliding shackle padlock shown in FIG. 11, as taken along lines 12—12 of FIG. 11, showing a cam arrangement for engaging (FIG. 12*a*) and disengaging (FIG. 12*b*) the pawl edge from the ratchet teeth.
Figure 12B:
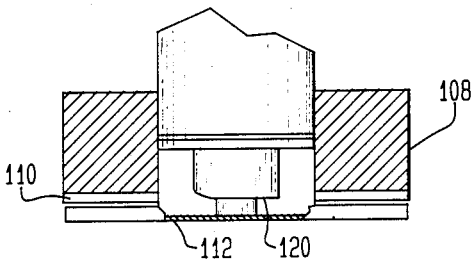

Referring to FIGS. 11, 12*a* and 12*b*, a fourth embodiment of the present invention is shown. Padlock 100, similar to the padlock FIGS. 3*a*, 3*b* and 4, includes a base 102 and side walls extending therealong in the longitudinal direction. As in the first embodiment, the base 102 and side walls define a groove into which the sliding shackle 108 is received and is slidable along. A plurality of incrementally separated ratchet teeth 110 extend longitudinally along the bottom surface of the sliding shackle 108 for operative engagement with an upturned pawl edge 114 provided on a flat spring plate 112 of the locking mechanism. The ratchet teeth 110 extend laterally across the width of the sliding shackle 108 as does the flat spring plate 112 which is disposed in a recess in the base 102 for mated engagement with the ratchet teeth 110. Each ratchet tooth 110 includes an inclined surface 110a facing the direction opposite the recess and the locking mechanism of the base 102, and a vertical surface 110*b* facing the recess and the locking mechanism.

As the sliding shackle 108 is slidably moved towards the recess and locking mechanism, the flat spring plate 112 bears against the inclined surfaces 110*a* of the ratchet teeth 110 and is biased in the downward direction until it reaches the apex between the inclined surface 110*a* and the vertical surface 110*b* whereupon the flat spring plate 112 returns to its normal position to engage the vertical surface 110*b* and thereby lock the sliding shackle 108 against movement in the opposite direction. Thus, the ratchet and pawl structure permits incremental movement of the sliding shackle 108 towards the recess of the base 102, such incremental movement being generally defined by the spacing between adjacent ratchet teeth, and more specifically defined by the distance between the vertical surfaces of the ratchet.

To disengage the pawl edge from the ratchet teeth, a conventional cam arrangement or any other suitable means may be utilized. When activated by turning of a key, cam 120 exerts a downward force on the flat spring plate 112 as shown in FIG. 12b. That action depresses the upturned pawl edge below the plane defined by the apexes of the ratchet teeth, thereby permitting free movement of the sliding shackle 108 both towards and away from the recess of the base 102.

To minimize the opportunities for forced attack and to provide the tightest fit possible between the shackle and the staple, it is preferable to taper the toe portion of the sliding shackle of FIGS. 11, 12*a* and 12*b* as shown in FIGS. 9–10. With that arrangement, the shackle can be urged towards the staple until the staple opening is completely filled by the tapered toe portion.

Figure 14:
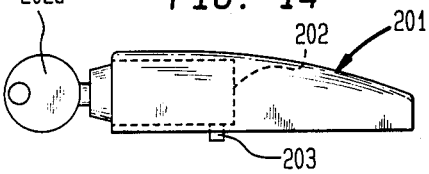
FIG. 14 is a right side elevational view of the sliding shackle component shown in FIG. 13.
Figure 15:
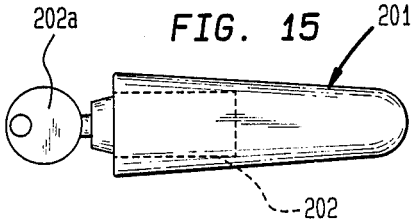
FIG. 15 is a top plan view of the sliding shackle component shown in FIG. 13.
Figure 16:
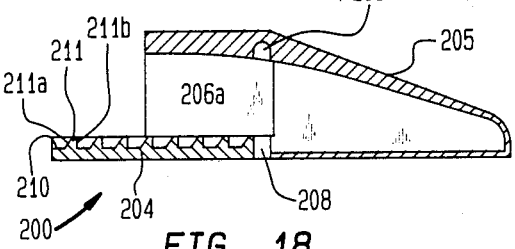
FIG. 16 is a sectional view of the base component of the sliding shackle padlock in accordance with the fifth embodiment of the present invention, as taken on line 16—16 of FIG. 13.
Figure 17:
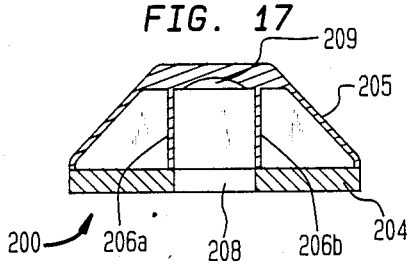
FIG. 17 is a sectional view of the base component of the sliding shackle padlock in accordance with the fifth embodiment of the present invention, as taken on line 17—17 of FIG. 13.

FIGS. 13–18 show a fifth embodiment of the present invention. The sliding shackle padlock in accordance with this embodiment is generally designated as 200 and includes a sliding shackle 201 and a base 202. As shown in FIGS. 14 and 15, sliding shackle 201 has a generally planar bottom surface and is tapered toward the front portion thereof in both the lateral and longitudinal directions. As in the third embodiment, shown in FIGS. 9 and 10, the tapering of the toe portion of the sliding shackle 201 in both the lateral and longitudinal directions provides for a more snug arrangement between the toe portion of the shackle and the staple since the staple opening will be completely filled by the toe portion of the shackle. It should be recognized that the degree of tapering in the longitudinal and lateral directions are dependent upon one another as well as the size of the staple opening or the range of staple openings for which a particular shackle is designed. Some of the purposes underlying this embodiment of the present invention may not be enjoyed if the toe portion of the shackle engages the staple in only the lateral or only the longitudinal direction, and thus, it is preferred that the shackle be tapered in both directions.

Sliding shackle 201 includes a cylinder lock 202 having a retractable lock pin 203 which is actuated by key 202a. The cylinder lock 202 can be any conventional commercially available lock which is structurally suited for disposition within the tapered shackle 201. The retractable lock pin 203 operates as a pawl in conjunction with base 204, as will be described below.

Base 204 of sliding shackle padlock 200 includes a protective cover portion 205 having a shackle chamber defined by walls **206*a* and 206*b*. A shackle opening 207, in communication with the exterior of protective cover 205 and the shackle chamber, is provided to receive sliding shackle 201. Remote from shackle opening 207 and within the shackle chamber, a laterally extending staple aperture 208 through the base 204 for receiving the staple of a hasp. Directly above and aligned with staple opening 208 is a staple recess 209 provided in protective cover 205 for receiving the top portion of a staple extending through staple opening 208, as shown in FIG. 18**.

Figure 18:
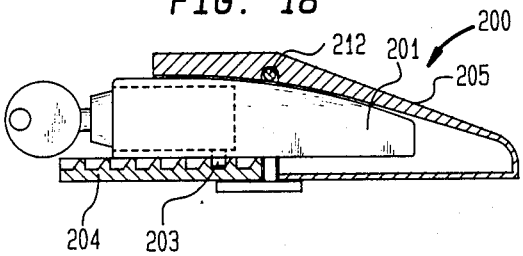
FIG. 18 is a sectional view similar to that shown in FIG. 16, but including a hasp, in partial cross-section, and also showing the sliding shackle locked therein, illustrating in particular the ratchet feature of the sliding shackle padlock in accordance with the fifth embodiment of the present invention.

Base 204 further includes a plurality of lateral recesses 210 extending longitudinally into the shackle chamber towards the staple opening 208 and arranged in spaced relationship to each other for operative communication with the retractable lock pin 203 of the sliding shackle 201, as shown in FIG. 18. A plurality of ratchet teeth 211 are defined by this arrangement. Each ratchet tooth 211 includes an inclined surface **211*a* and vertical surface 211*b*. In FIG. 18, retractable lock pin 203 is shown as being locked against vertical surface 211*b* of a ratchet tooth 211, thus locking in a snug arrangement the toe portion of sliding shackle 201 within the staple opening of staple 212. One skilled in the art will readily recognize that the retractable lock pin 203 can be spring-biased in its extended position so that upon insertion of the sliding shackle 201 into the shackle chamber, the retractable lock pin 203 bears against the inclined surface 211*a* to depress the retractable lock pin 203 against the force of the spring biasing the same. Once the retractable lock pin 203 rides over the apex of the inclined surface 211*a* and the vertical surface 211*b*, the spring of lock pin 203 will again bias the lock pin 203 so that it will engage the vertical surface 211*b* and the sliding shackle 201 cannot be removed from within the shackle chamber without the key 202*a***.

With such an arrangement, the staple 212 of the hasp is entirely hidden within the protective cover 205 of base 204 and the tapered feature of the toe portion of shackle 201 provides a tight arrangement such that sliding shackle padlock 200 becomes fixed to staple 212 of the hasp and is not easily removed therefrom to open the door or other closure to be locked.

It is to be noted that the number of and space between the ratchet teeth 211 can be varied so that shackle 201 can be longitudinally moved into the shackle chamber at smaller increments thereby providing a greater degree of adjustabiliy and thus a more snug arrangement of the toe portion of shackle 201 within the staple opening of staple 212. It should be further noted that staple recess 209 in protective cover 205 aids in defending a torsional attack on the sliding shackle padlock 200 whereby the entire padlock 200 is rotated in an attempt to weaken the locking arrangement.

Figure 19:
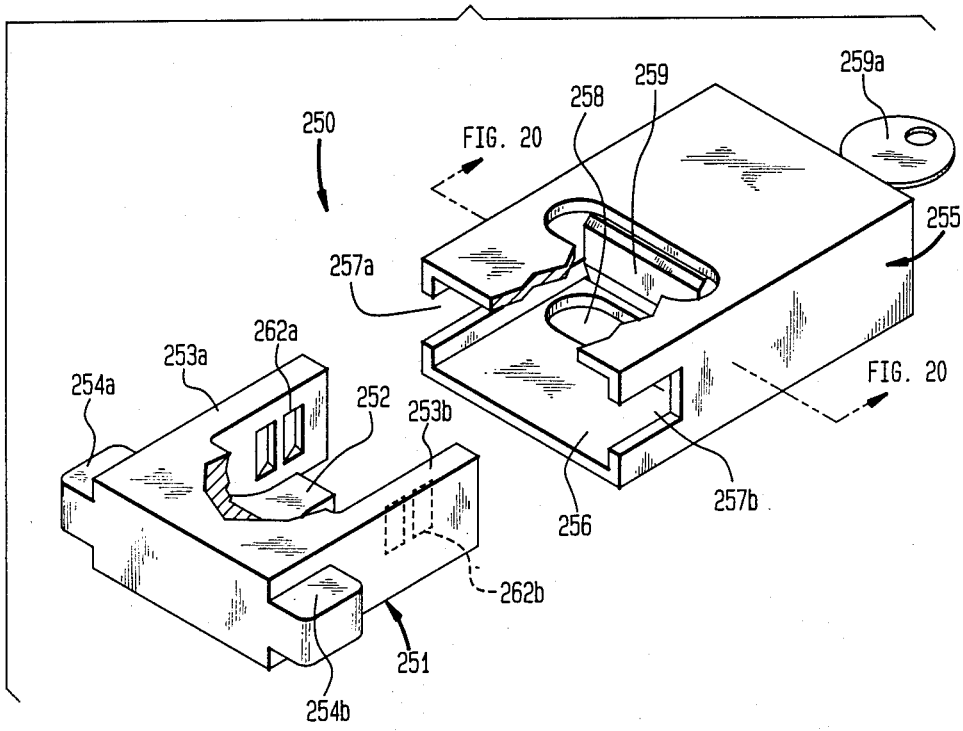
FIG. 19 is and exploded, partially broken away perspective view of a sliding shackle padlock in accordance with a sixth embodiment of the present invention.
Figure 20:
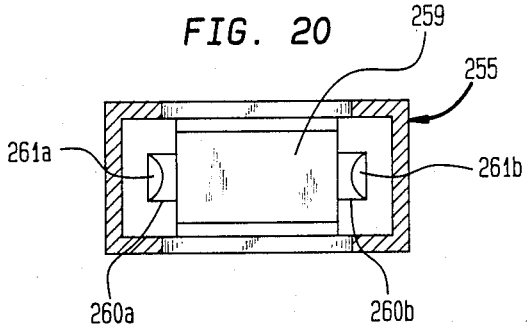
FIG. 20 is a sectional view of the sliding shackle padlock in accordance with the sixth embodiment as taken on line 20—20 of FIG. 19, illustrating in particular the cam actuated pawls which make up a part of the ratchet feature.

In accordance with a sixth embodiment of the present invention, FIGS. 19 and 20 show an arrangement in which the ratcheting feature is disposed on the shackle member itself (and in particular, on the sides thereof), instead of on the top of the base or the bottom of the shackle. Thus, FIG. 19 shows a sliding shackle padlock generally designated as 250 in accordance with the present invention and having a sliding shackle member 251 having a tapered shackle 252 disposed between two longitudinally extending legs **253*a* and 253*b*. Remote from the legs 253*a* and 253*b* are shoulder portions 254*a* and 254*b*. Sliding shackle padlock 250 further includes a shackle receiving member 255 having a shackle chamber 256 sized to slidably receive the legs 253*a* and 253*b*, and shoulder slots 257*a* and 257*b* for receiving the shoulder portions 254*a* and 254*b*, respectively. The shackle receiving member 255 also includes a staple aperture 258 defined by apertures in the top wall and bottom wall. Of course, the structure of the shackle receiving member 255** can be altered to include only an aperture in the bottom wall for receiving and concealing the staple of a hasp.

A lock 259 is provided in the shackle chamber 256 adjacent to the staple aperture 258. FIG. 20 shows the lock 259 disposed in the medial region of the shackle receiving member 255 and having two laterally extending lock pins **260*a* and 260*b* which are spring biased and include inclined surfaces 261*a* and 261*b*, respectively, which inclined surfaces facilitate in forcing the lock pins 260*a* and 260*b* inwardly when the legs 253*a* and 253*b* are inserted longitudinally into the shackle receiving member 255 and forced into the lock pins 260*a* and 260*b*. Once the end surfaces of the legs 253*a* and 253*b* pass the lock pins 260*a* and 260*b*, the lock pins 260*a* and 260*b* will slide along the inner surfaces of the legs 253*a* and 253*b* into an aligned pair of notches 262*a* and 262*b*. The notches 262*a* and 262*b* include inclined surfaces facing the ends of the legs 253*a* and 253*b* and against which the lock pins 260*a* and 260*b* bear during insertion of the shackle member 251, and vertical surfaces for fixedly engaging lock pins 260*a* and 260*b* when the sliding shackle member 251 is in an assembled position within the shackle receiving member 255. As in the fifth embodiment, shown with reference to FIGS. 13–18, the ratchet feature of this embodiment, defined by the notches 262 and the lock pins 260, can be altered to provide for smaller increments of longitudinal movement thereby enabling a more snug engagement of tapered shackle 252** within the staple opening of the staple.

To remove the sliding shackle padlock 250 from the staple of a hasp, key **259*a* is utilized to effect the inward lateral movement of lock pins 260 so that sliding shackle member 251 can be slidably removed from shackle receiving member 255**.

Figure 21:
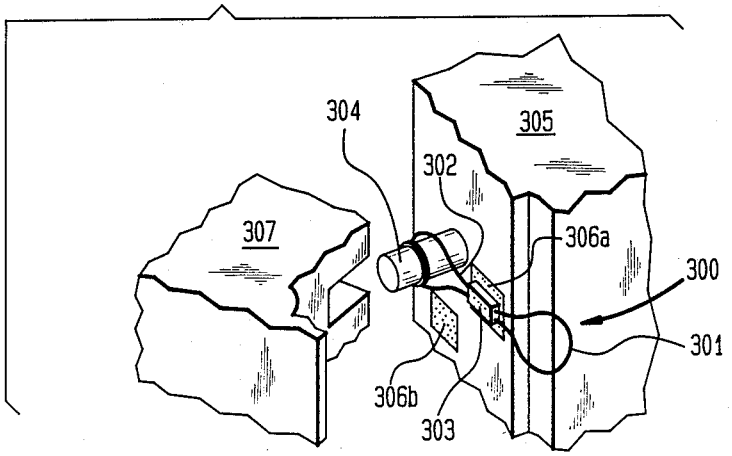
FIG. 21 is a broken away side view of a car door with a shackle fastening means extending therefrom, illustrating a particular application of a seventh embodiment in accordance with the present invention.

Turning to FIGS. 21–24, a seventh embodiment of the present invention is shown, wherein the concepts underlying the present invention are particularly adapted for use with hasps or other fastening means which are removably secured to a door jamb. As these figures illustrate, the outwardly opening door of a car is particularly well suited for the application of the sliding shackle padlock in accordance with this embodiment of the present invention where the sliding shackle padlock represents auxiliary locking means intended to prevent unauthorized opening of the car door even if the primary car door lock is successfully overcome. Thus, FIG. 21 shows a broken away side view of the side door of a car having a loop 301 of a cable 300 extending from between the car door and the door jamb. At the end remote from the shackle loop 301, a strike loop 302 is provided, the shackle loop 301 and the strike loop 302 being connected at 303. The cable 300 can be made from any suitably strong material such as metal, and, while it is not necessary, the cable 300 should be flexible so as to conform to the various shapes and sizes of doors and door jambs.

Figure 22:
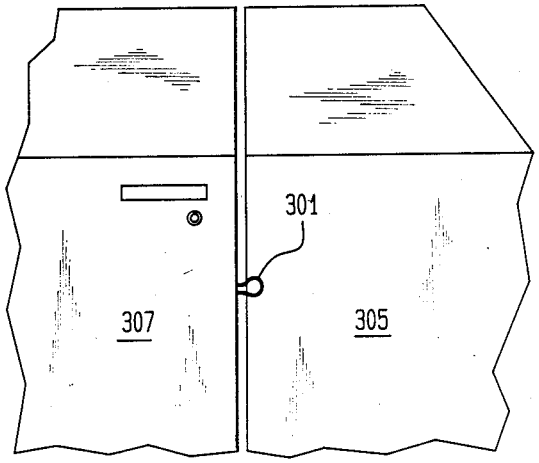
FIG. 22 is a broken away perspective view of the car door and car door jamb of FIG. 21, with the car door partially opened, illustrating in particular the arrangement of the shackle fastening means on the car door jamb.

As shown in FIG. 22, the strike loop 302 is looped over a strike 304 of the door jamb 305. If a staple is provided on the door jamb 305 instead of a strike, a hook or clip of some type may be provided on the strike loop 302 to removably secure the same thereto. The cable 300 is maintained in a generally horizontal position by Velcro fastening means provided at the connection 303 in conjunction with Velcro fastening means 306*a* disposed horizontally adjacent to the strike 304. The Velcro fastening means 306*b* is disposed vertically adjacent to strike 304 for fastening the cable 300 in a vertical position to store the same when the lock of the present embodiment is not in use. Of course, a permanently and pivotally fixed cable or other fastening means can be provided within the scope of the present invention.

Figure 23:
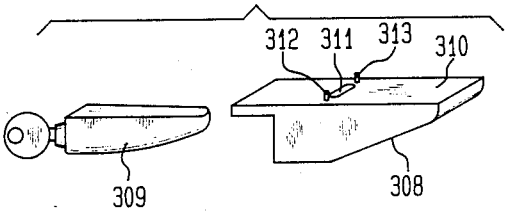
FIG. 23 is an exploded perspective view of a sliding shackle padlock in accordance with the seventh embodiment of the present invention.

FIG. 23 shows a sliding shackle padlock 308, similar to that shown in FIGS. 13–18, which is suitable for use in conjunction with the cable 300 to secure the door 307 from being opened. Thus, the sliding shackle padlock 308 includes a tapered shackle 309 and a base 310. The base 310 includes an aperture 311 to receive the shackle loop 301 and guide posts 312 and 313 arranged on either side of aperture 311. The guide posts 312 and 313 protrude into the slot formed between the door 307 and the door jamb 305 so as to hinder a torsional attack on the sliding shackle padlock 308 whereupon one would rotate the sliding shackle 308 in an attempt to break cable 300 as well as a fishing attack whereupon one would insert an implement into the slot formed between the door 307 and the door jamb 305 in an attempt to cut or otherwise weaken the cable 300.

Figure 24A:
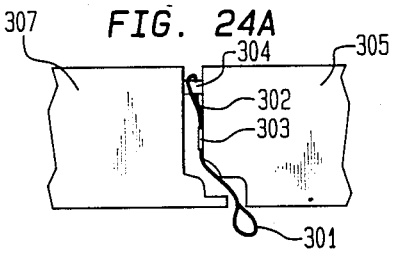
FIG. 24*a* is a broken away top view of the car door and car door jamb in FIGS. 21 and 22, with the car door in the closed position.
Figure 24B:
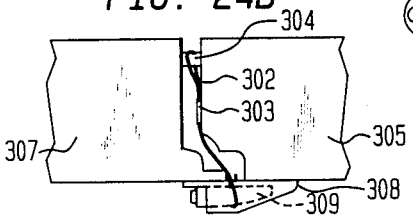
FIG. 24*b* is a broken away top view similar to that shown in FIG. 24*a*, together with the sliding shackle padlock secured to the shackle fastening means fixed to and extending from the car door jamb of the car door.

FIG. 24B shows the sliding shackle padlock 308 in assembled position on the cable 300 wherein the shackle loop 301 is inserted through the aperture 311 of the base 310 and the shackle 309 is inserted longitudinally into the base 310 and through the shackle loop 301. Upon continued insertion of the shackle 309, the cable 300 is loaded in tension as shown in FIG. 24B (when compared with FIG. 24A showing the cable 300 without a sliding shackle padlock thereon). Preferably, the shackle 309 is tapered in both the longitudinal and lateral direction and a ratcheting feature of some type is employed so that the cable 300 can be properly secured in tension by the tapered shackle 309. Thus, the door 307 is fixed in the closed position by the arrangement between the sliding shackle padlock 308 and the cable 300. It is to be noted that the cable 300 is anchored against the strike 304, one of the strongest portions of the car. Since strike 304 cooperates with a latch on the door 307 to safely maintain the same in the closed position, it is designed to provide maximum strength in the lateral direction thereof. Thus, the strike 304 provides a considerable degree of strength to the sliding shackle padlock and cable arrangement.

Figure 25:
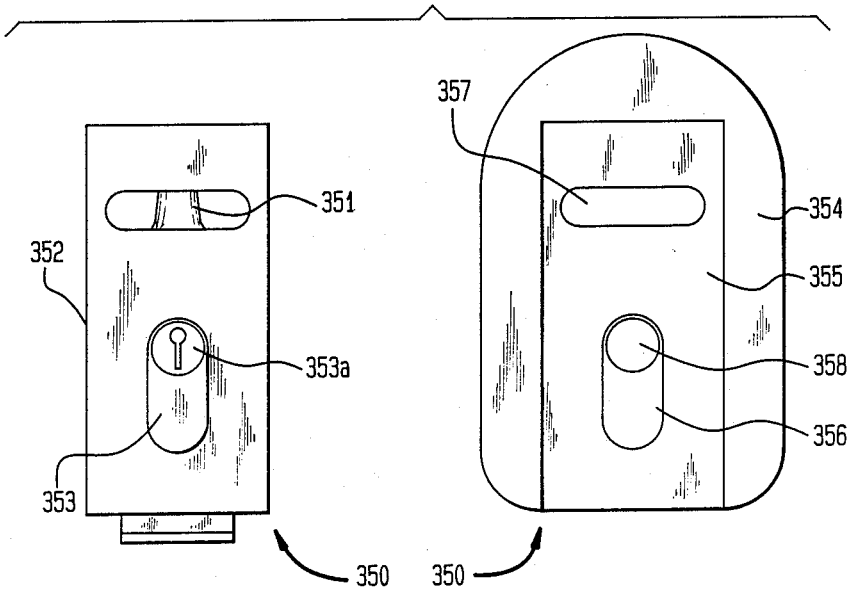
FIG. 25 is an exploded view of an eighth embodiment of the present invention, showing a top plan view of the sliding shackle padlock and a bottom plan view of the inside surface of a protective cover adapted to be secured to the sliding shackle padlock.
Figure 26:
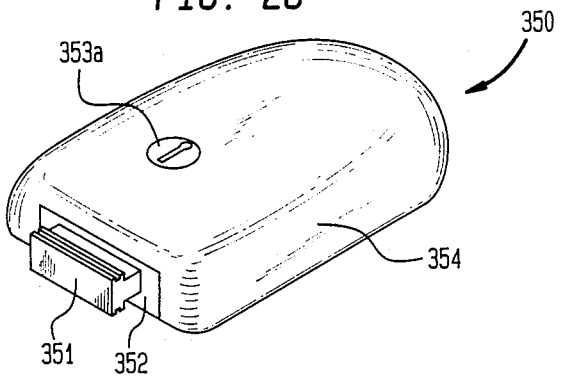
FIG. 26 is a perspective view of the sliding shackle padlock and protective cover in accordance with the eighth embodiment of the present invention shown in FIG. 25, illustrating the same in an assembled position.
Figure 27:
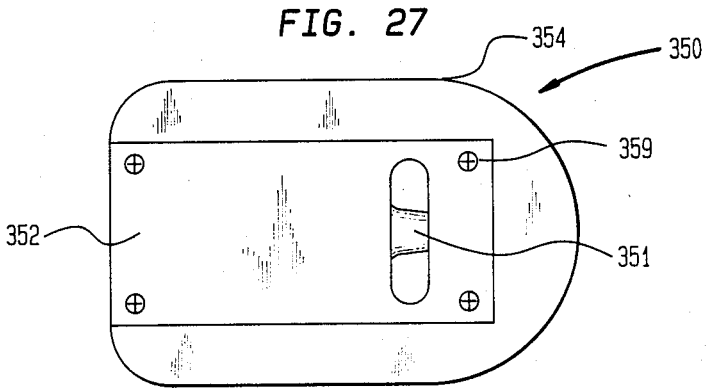
FIG. 27 is a bottom view of the sliding shackle padlock and protective cover shown in FIG. 26.

FIGS. 25–27 show an eighth embodiment of the present invention wherein the sliding shackle padlock 350 includes sliding shackle 351 slidably mounted within a base 352, which base includes a lock 353 mounted therein for operative communication with the sliding shackle 351. The sliding shackle padlock 350 further includes a protective cover 354 which is made separately from the sliding shackle 351 and the base portion 352. The sliding shackle 351 and the base portion 352 are similar in structure and operation to the first embodiment of the present invention shown in FIGS. 3*a*, 3*b* and 4. The protective cover 354 includes a base recess 355 to receive the base portion 352, and a lock recess 356 to receive the lock 353. A staple recess 357 is provided within the base recess 355 for alignment with the staple aperture through the base 352. The staple recess 357 will receive the top portion of the staple of a hasp as in the fifth embodiment of the present invention. A key opening 358 is provided within the lock recess 356 so as to expose the key hold 353*a* of the lock 353 when the base 352 is secured within the protective cover 354 by screw fasteners 359 or any other suitable fastening means.

Thus, when sliding shackle padlock 350 is assembled and locked on a staple, the door or other closure sought to be locked is secured against unauthorized access as in the previous embodiment. In accordance with the concepts underlying the present invention, the staple will be hidden and inaccessible to cutting or prying tools, and will further provide protection against a torsional attack on the sliding shackle padlock 350 as the top portion of the staple is disposed within staple recess 357.

While the foregoing invention has been described with reference to its preferred embodiments, various alterations and modifications will occur to those skilled in the art. For example, the side walls 14 need not include notches for receiving the shackle. Instead, the shackle may have a width approximately equal to the distance between the side walls, and other known means may be utilized to capture the shackle of sliding movement on the base. Also, the various features in the disclosed embodiments can be interchanged and modified with one another as may be required for particular applications of the present invention. Alterations and modifications such as these are intended to fall within the scope of the appended claims.

What is claimed is:

1. A sliding shackle padlock for use with a fastening member having a fastening aperture, said sliding shackle padlock comprising:

(a) base means having a first surface and an opening extending through said base means, said opening being adapted to receive therethrough a portion of the fastening member so that at least a portion of the fastening aperture is arranged adjacent to said first surface;

(b) an elongated shackle member slidably movable relative to said base means along said first surface for insertion into and engagement with the fastening aperture, said elongated shackle member having a tapered section, said tapered section having a first end and a second end, and said first end having a lateral dimension less than the lateral dimension of said second end; and (c) securement means for securing said elongated shackle member to said base means when said tapered section is in tight engagement within the fastening aperture.

2. The sliding shackle padlock claimed in claim 1, wherein said securement means includes incremental securing means for incrementally securing said elongated shackle member at a plurality of different positions relative to said base means, whereby said sliding shackle padlock can be used with a variety of different fastening members having differently sized fastening apertures.

3. The sliding shackle padlock claimed in claim 2, wherein said shackle member slidably moves relative to said base means in a longitudinal direction and said incremental securing means are provided at incrementally separated positions in said longitudinal direction so as to permit said elongated shackle member to be slidably moved at predetermined increments.

4. The sliding shackle padlock claimed in claim 1, wherein said elongated shackle member is slidably movable in a first direction relative to said base means, said first direction being parallel to an imaginary line extending from said second end to said first end of said tapered section, and said securement means includes incremental securing means for securing said elongated shackle member against movement in a second direction opposite from said first direction at a plurality of different positions relative to said base means, whereby said sliding shackle padlock can be used with a variety of different fastening members having differently sized apertures.

5. The sliding shackle padlock claimed in claim 3, wherein said incremental securing means comprises a ratchet and pawl arrangement operatively associated with said elongated shackle member and said base means.

6. The sliding shackle padlock claimed in claim 1, wherein the dimension of said tapered section transverse to said lateral dimension is tapered towards said first end.

7. The sliding shackle padlock claimed in claim 6, wherein the degree of tapering of said lateral and said transverse dimensions are dependent upon one another so that a greater surface area of said tapered portion engages the fastening aperture when inserted thereinto.

8. The sliding shackle padlock claimed in claim 3, including a protective cover connected to said base means for covering at least said tapered section of said elongated shackle member and the fastening member.

9. The sliding shackle padlock claimed in claim 7, wherein said protective cover includes a recess for receiving at least a portion of the fastening member.

10. A shackle padlock for use with a fastening member having a fastening aperture, said shackle padlock comprising:

(a) base means having a first surface and an opening extending through said base means, said opening being adapted to receive therethrough a portion of the fastening member so that at least a portion of the fastening aperture is arranged adjacent to said first surface;

(b) a shackle member for engaging the fastening aperture, said shackle member having a tapered section, said tapered section having a first end and a second end, and said first end having a lateral dimension less than the lateral dimension of said second end; and (c) securement means for locking said shackle member to said base means when said tapered section is in tight engagement within the fastening aperture, said securement means including incremental securing means for incrementally securing said shackle member at a plurality of different positions relative to said base means, whereby said shackle padlock can be used with a variety of different fastening members having differently sized fastening apertures.

11. The shackle padlock claimed in claim 10, wherein said shackle member moves relative to said base means in a longitudinal direction and said incremental securing means are provided at incrementally separated positions in said longitudinal direction, so as to permit said shackle member to be moved at predetermined increments.

12. The shackle padlock claimed in claim 11, wherein said incremental securing means comprises a ratchet and pawl arrangement operatively associated with said shackle member and said base means.

13. The shackle padlock claimed in claim 10, wherein said shackle member is movable in a first direction relative to said base means, said first direction being parallel to an imaginary line extending from said second end to said first end of said tapered section, and said securement means includes incremental securing means for securing said shackle member against movement in a second direction opposite from said first direction at a plurality of different positions relative to said base means, whereby said shackle padlock can be used with a variety of different fastening members having differently sized apertures.

14. The shackle padlock claimed in claim 12, wherein said ratchet and pawl arrangement includes a plurality of incrementally separated ratchet teeth on said base means and a spring-biased pawl on said shackle member.

15. The shackle padlock claimed in claim 14, wherein each said ratchet tooth has an inclined surface against which said spring-biased pawl bears when said shackle member is slidably moved towards said opening of said base means, and a vertical surface against which said spring-biased pawl bears to prevent said elongated shackle member from being slidably moved away from said opening of said base means.

16. The shackle padlock claimed in claim 12, wherein said ratchet and pawl arrangement includes a plurality of incrementally separated ratchet teeth on said shackle member and a spring-biased pawl associated with said securement means.

17. The shackle padlock claimed in claim 14, wherein each said ratchet tooth has an inclined surface against which said spring-biased pawl bears when said shackle member is slidably moved towards said opening of said base means, and a vertical surface against which said spring-biased pawl bears to prevent said elongated shackle member from being slidably moved away from said opening of said base means.

18. The shackle padlock claimed in claim 10, wherein the dimension of said tapered section transverse to said lateral dimension is tapered towards said first end.

19. The shackle padlock claimed in claim 18, wherein the degree of tapering of said lateral and said transverse dimensions are dependent upon one another so that a greater surface area of said tapered portion engages the fasten aperture when inserted thereinto.

20. The shackle padlock claimed in claim 12, including a protective cover connected to said base means for covering at least said tapered section of said shackle member and the fastening member.

21. The shackle padlock claimed in claim 20, wherein said protective cover includes a recess for receiving at least a portion of the fastening member.

22. In combination:

a support member having an exterior surface;

an outwardly opening closure member adjacent said support member, said closure member being movable in a first direction away from said support member;

a fastening member on said support member, said fastening member having a fastening aperture;

a shackle padlock for securing said closure member against movement in said first direction, said shackle padlock comprising, (i) base means having an opening therethrough, (ii) an shackle member for said base means, said shackle member having a tapered section, said tapered section having a first end and a second end, said first end having a lateral dimension less than the lateral dimension of said second end, and (iii) securement means for locking said shackle member relative to said base means; and said shackle padlock being arrangeable so that said base means is against both said closure member and said support member and said opening of said base means receives said fastening member therethrough, whereby said shackle member is insertable through said fastening aperture of said fastening member so that said shackle member is secured to said base means by said securement means when said tapered section is in tight engagement within the fastening aperture.

23. The combination claimed in claim 22, wherein said support member includes a hidden surface which is substantially inaccessible when said closure member is in the closed position, and wherein said fastening member is secured to said hidden surface.

24. The combination claimed in claim 23, wherein said fastening member is flexible and is adapted to be placed in tension when said tapered section of said shackle member is in tight engagement within said fastening aperture.

25. The combination claimed in claim 24, wherein said closure member is an automobile door and said support member is the jamb associated with said automobile door.

26. The combination claimed in claim 23, wherein said fastening member is removably connected to said support member.

27. The combination claimed in claim 22, wherein the dimension of said tapered section transverse to said lateral dimension is tapered towards said first end.

28. The combination claimed in claim 27, wherein the degree of tapering of said lateral and said transverse dimensions are dependent upon one another so that a greater surface area of said tapered portion engages said fastening aperture when inserted thereinto.

29. The combination claimed in claim 22, including a protective cover connected to said base means for covering at least said tapered portion of said elongated shackle member and said fastening member.

30. The combination claimed in claim 22, wherein said securement means includes incremental securing means for incrementally securing said shackle member at a plurality of different positions relative to said base means, whereby said shackle padlock can be used with a variety of different fastening members having differently sized fastening apertures.

31. The combination claimed in claim 30, wherein said shackle member moves relative to said base means in a longitudinal direction and said incremental securing means at a plurality of different positions are provided at incrementally separated positions in said longitudinal direction, so as to permit said shackle member to be moved at predetermined increments.

32. The shackle padlock claimed in claim 22, wherein said shackle member is movable in a first direction relative to said base means, said first direction being parallel to an imaginary line extending from said second end to said first end of said tapered section, and said securement means includes incremental securing means for securing said shackle member against movement in a second direction opposite from said first direction at a plurality of different positions relative to said base means, whereby said shackle padlock can be used with a variety of different fastening members having differently sized apertures.

* * * * *